United States Patent [19]

Sorensen

[11] Patent Number: 4,816,977

[45] Date of Patent: Mar. 28, 1989

[54] LAMP WITH REMOVABLE BULB CAPSULE

[75] Inventor: Robert C. Sorensen, Burr Ridge, Ill.

[73] Assignee: RCS Industries, Inc., Alsip, Ill.

[21] Appl. No.: 150,577

[22] Filed: Feb. 16, 1988

[51] Int. Cl.[4] ..... F21V 17/00

[52] U.S. Cl. ..... 362/448; 362/310; 362/362; 313/318

[58] Field of Search ..... 362/310, 362, 263, 448, 362/455; 313/318

[56] References Cited

U.S. PATENT DOCUMENTS 3,355,612 11/1967 Peek, Jr. ..... 313/318

*Primary Examiner*—Stephen F. Husar

*Attorney, Agent, or Firm*—Emrich & Dithmar

[57] ABSTRACT

The lamp has a frustoconical reflector with a mounting shell attached to its small end. A removable member includes a threaded base and socket. The socket protrudes through the hole in the mounting shell and into the reflector. It removably receives a replaceable bulb capsule. Means are provided for retaining the removable member to the mounting means.

20 Claims, 1 Drawing Sheet

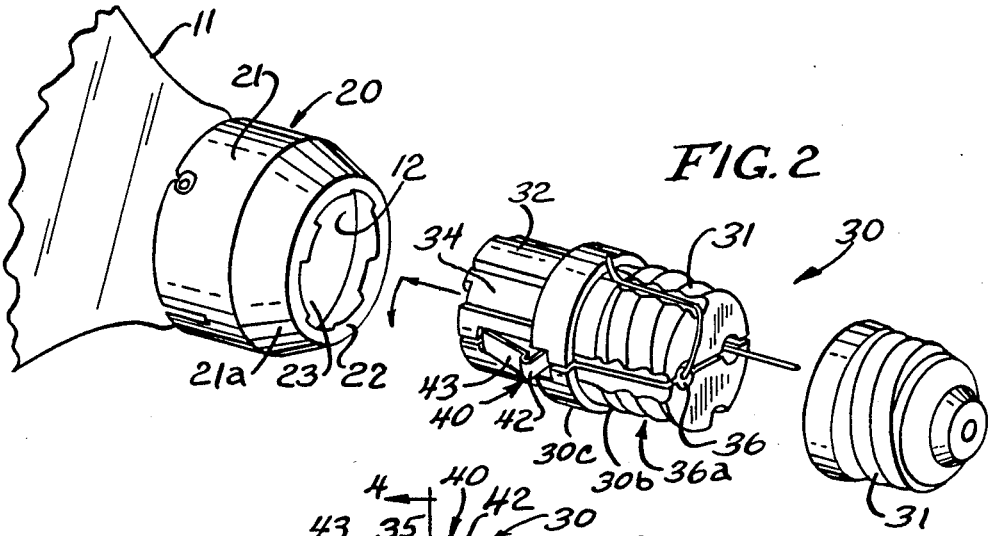
FIG. 2
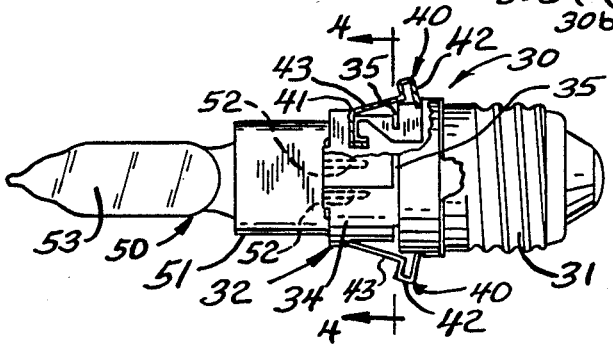
FIG. 3
FIG. 4
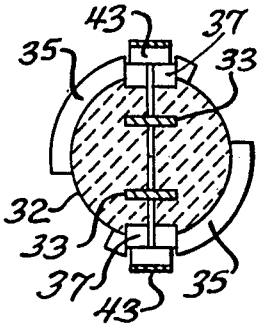
FIG. 5
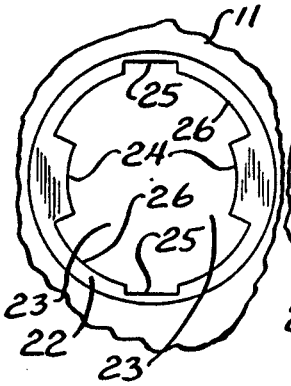
FIG. 6
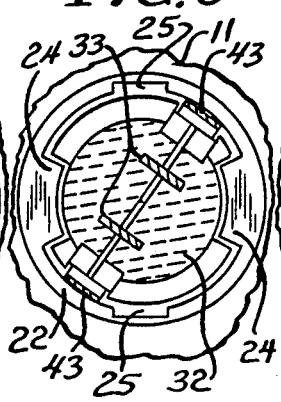
FIG. 7
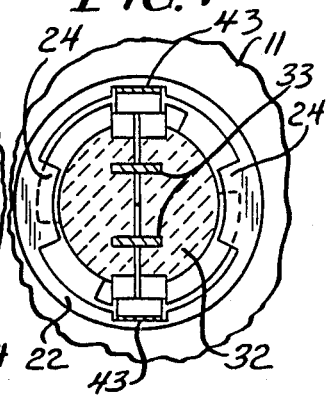
FIG. 1
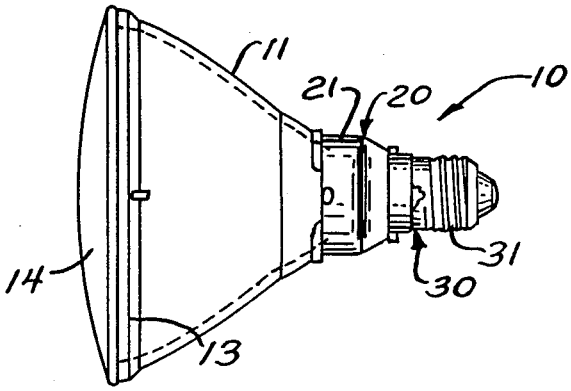

LAMP WITH REMOVABLE BULB CAPSULE

BACKGROUND OF THE INVENTION

Lamps used in display lighting commonly include a bulb contained within a generally frustoconical glass envelope. The interior of the envelope is metallized to define a reflector. To provide a whiter light throughout its life, the bulb is filled with gases including halogen gas. When such a lamp burns out, it is simply discarded and replaced with a new one. When used in retail stores and other commercial installations, these lamps are on many hours of each day. Thus, they must be replaced frequently. The combination of the cost of the bulb-within-an-outer-envelope construction and the frequency of replacing the lamp used in display lighting makes such lamps expensive to use.

Outdoor lamps are not as expensive because they do not have an inner bulb and they are not on as many hours in a day. Nevertheless, whenever they burn out, outdoor lamps must be discarded in their entirety. Most vehicle headlamps must also be discarded when the bulb therein burns out.

SUMMARY OF THE INVENTION

It is therefore an important object of the present invention to reduce the cost of using the type of lamp having an outer envelope, such as a reflector and a bulb.

It is another object of the present invention to accomplish such cost reduction by permitting the reuse of the outer envelope, the lens and other elements, and replacing only the bulb. Another object is to enable ready removal of the bulb in such lamps and to enable ready replacement thereof.

In summary, there is provided a lamp comprising an outer envelope having a rear portion and an opening therethrough, mounting means on the rear portion and including a hole, a removable member including a threaded base and a socket, the socket protruding through the hole and into the space defined by the reflector, means for retaining together the mounting means and the removable member on the mounting means, and a replaceable bulb capsule including a male element which is removably mated with the socket.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a side elevation view of a lamp constructed in accordance with the features of the present invention;

FIG. 2 is an exploded view of the several portions of the lamp;

FIG. 3 is a side elevational view of the removable member and the removable bulb capsule applied thereto;

FIG. 4 is a view in section taken along the line 4—4 of FIG. 3;

FIG. 5 is a fragmentary view of the mounting shell showing the transverse wall;

FIG. 6 is a sectional view of the removable member assembled to the mounting shell taken on the line 4—4, in the position where the removable member can be installed or removed; and FIG. 7 is a view like FIG. 6 but with the removable member in the position where it cannot be removed.

DETAILED DESCRIPTION OF THE PREFERRED EMBODIMENT

Turning now to the drawings and more particularly to FIG. 1 thereof, there is depicted a lamp 10 constructed in accordance with the present invention. The lamp includes an outer envelope which, in the embodiment depicted, is generally frustoconical in shape. Its interior is metallized to provide a reflector 11 for the light created by the bulb therein. Attached to the front portion 13 of the reflector 11 is a light-transmitting plate or lens 14. The reflector 11 and the lens 14 are modified standard items. The principles of the present envelope could be utilized with other types of outer envelopes.

Attached at the rear portion 12 (FIG. 2) of the reflector 11 is a mounting shell 20 to which is removably attached a removable member 30 having a threaded base 31. As will be described, a replaceable bulb capsule is plugged to the member 30, which capsule is located in the space defined by the reflector 11. The lamp 10 is utilized in the usual way. Its base is threaded into a standard lamp socket and when the socket is energized, the lamp 10 will emit light through the lens.

Turning now to FIG. 2, further details of the lamp 10 will be described. In the embodiment shown, the mounting shell 20 is constructed of brass sheet, stamped into the shape shown. It includes a skirt 21 matching the shape of the rear portion 12 of the reflector 11. The shell 20 also includes a frustoconical wall **21*a* a which extends to a transversely extending wall 22. In the wall 22 is a hole 23, the periphery of which has formations thereon. Referring also to FIG. 5, these formations include a pair of diametrically opposed tongues 24 extending into the hole 23 and toward each other. Also, there is a pair of diametrically opposed notches 25 and a pair of diametrically opposed guide edges 26, each edge 26 being located between a tongue 24 and the associated notch 25**.

The removable member 30 includes a body **30*a* of generally cylindrical shape having an end portion 30*b*, a central portion 30*c* and a head 32. The head may be composed of ceramic or thermoplastic, for example. In a preferred embodiment, the body 30*a* is longitudinally split in half to provide two mating pieces. Within the portion 30*a* is a diode 36 and wiring to connect the socket to the threaded base 31. The portion 30*a* fits into the base 31 and is permanently attached thereto. In the head 32, there is a pair of longitudinally extending openings within which are located socket terminals 33 that are generally parallel to each other. The head 32 also has a pair of longitudinally extending grooves 34 and a pair of circumferentially extending grooves 35 between the central portion 30*c* and the head 32**.

The removable member 30 also includes a pair of latching elements 40, each having one an attachment end 41, the other end being bent to form a finger engagement portion 42, the part between the two ends defining a camming portion 43. The ends 41 of the latching elements 40 are attached to the head 32 adjacent the forward end thereof and at diametrically opposed points on the sidewall thereof. The sidewall of the head is longitudinally recessed to accommodate the elements 40. Each latching element 40 is movable between a latching position wherein the engagement portion 42 is away from the head 32 to an unlatching position wherein it is depressed into the longitudinal recess.

The lamp 10 further comprises a replaceable bulb capsule 50 having a base 51 which is generally rectangular in cross section and a pair of pins 52. The pins 52 are generally parallel to each other. The bulb capsule 50 also includes the bulb 53 which contains gases including halogen, for example. The base 51 may be hollow and it may be made of ceramic or thermoplastic for example. The leads of the halogen bulb are inserted into the pins 52 and then the base 51 is potted.

The capsule 50 is first mounted on the removable member 30 by inserting the pins 52 into the socket terminals 33. Then the combination of the removable member 30 and the replaceable bulb capsule 50 are mounted on the mounting shell 20. This is accomplished as follows. The two longitudinally extending grooves 34 are respectively aligned with the mounting tongues 24. At the same time the camming portions 43 of the two latching elements 40 are aligned with the edges 26 on the mounting shell 20. These latching elements 40 are biased outwardly as previously explained. The removable member 30 is then forcibly pushed forwardly, whereby the edges 26 automatically deflect the latching elements 40, and specifically the camming portions 43 thereof, inwardly, toward the head 32. When the portion 30*c* of the head 32 is seated against the wall 22 of the shell 20, the removable member 30 is rotated clockwise while the camming portions 43 ride on the edges 26, respectively, until they reach the notches 25. The outward bias of the latching elements 40 cause them to snap outwardly, whereupon the camming portions 43 become located within the notches 25, respectively. As this rotation is taking place, the tongues 24 enter the circumferentially extending grooves 35, whereby axial movement of the removable member 30 is no longer possible. With the camming portions 43 in the notches 25, further rotation of the removable member 30 is not possible and the removable member is retained in place.

With assembly completed, the lamp 10 will assume the condition depicted in FIG. 1 and it can be used in the usual way. When the bulb 53 burns out, the removable member 30 is disassembled to enable the replaceable bulb capsule 50 to be replaced. This removal is accomplished in the following manner. While holding the reflector 11 and the mounting shell 20 fixedly attached thereto, one grips the engagement portions 42 of the latching elements 40 with the thumb and forefinger, pushing them toward the head 32, against the outward biasing action of these latching elements. This causes the camming portions 43 to be located outside of the notches 25. Now the latching elements 40 are again in their unlatching positions and the removable member 30 may be rotated counterclockwise while the camming portions 43 engage the edges 26, respectively. This rotation causes the tongues 24 to be located outside of the circumferentially extending grooves 35, thereby enabling the removable member 30 to be withdrawn from the mounting shell 20.

The replaceable bulb capsule 50 is then exposed and can be pulled out of the socket terminals 33 and replaced with a fresh capsule. The removable member 30 with the fresh capsule can then be reinstalled as above described.

It may be seen that the lamp 10 includes keeper structure in the form of the tongues 24 on the mounting shell 20 and keeper structure in the form of circumferentially extending grooves 35 on the removable member 30. This keeper structure is constructed and arranged to releasably prevent removal of the removable member 30. Also, the lamp 10 includes latching structure on the mounting shell 20 in the form of the notches 25 and latching structure on the removable member 30 in the form of the latching elements 40. This locking structure ensures that the removable element cannot be rotated into the position where it can be withdrawn. The keeper structure and the locking structure enable the mounting shell to releasably retain the removable member 30.

In the past when lamps of the general type and character depicted in FIG. 1 are used, and they burn out, the entire lamp must be replaced. However, by utilizing the invention described above, all that needs to be replaced is the replaceable bulb capsule 50, thereby making it more economical to use such lamps. Also, because of the construction, the lamp 10 has a shape and dimension substantially the same as currently available lamps. In other words, it can be used in the same kind of lighting devices.

The sizes of the head 32 and the capsule 50 are such that the filament of the bulb 53 will be located at the optically correct spot within the reflector 11 to attain maximum light output.

Despite the existence of the hole 23 in the mounting shell 20, the light output unexpectedly and surprisingly exceeds that from currently available lamps that do not have a replaceable bulb capsule. This is thought to be true because the filament of the bulb 53 can be positioned more rearwardly and, therefore, at a better point in respect to the metallized reflector 11.

The tolerances of manufacture are not as severe as are necessary with a permanent bulb.

What has been described therefor is an improved lamp utilizing a removable member to enable the bulb capsule to be readily replaced. While a particular embodiment of this invention has been described, it is to be understood that changes can be made in such embodiment without departing from the spirit or scope of the invention as defined in the claims.

What is claimed:

1. A lamp for use with a replaceable bulb capsule, comprising a reflector having a front portion and a rear portion and an opening through said rear portion, a light transmitting member on said front portion, mounting means on said rear portion and including a hole, a removable member including a threaded base and a socket, said socket protruding through said hole and into the space defined by said reflector and being constructed to removably receive a replaceable bulb capsule, and means for retaining said removable member on said mounting means.

2. The lamp of claim 2, wherein said reflector is generally frustoconical and has a metallized interior.

3. The lamp of claim 1, wherein said light transmitting member is a lens.

4. The lamp of claim 1, wherein said socket includes two substantially parallel holes.

5. The lamp of claim 1, wherein said socket is ceramic.

6. The lamp of claim 1, wherein said socket has first and second mating parts.

7. A lamp for use with a replacement bulb capsule, comprising an outer envelope having a rear portion and an opening therethrough, a light transmitting member on said front portion, mounting means on said rear portion and including a hole, a removable member including a threaded base and a socket, said socket protruding through said hole and into the space defined by said outer envelope and being constructed to removably receive a replacement bulb capsule, and means for retaining said removable member on said mounting means, said retaining means including first latching structure on said mounting means and second latching structure on said removable member, said first and second latching structures being constructed and arranged to releasably latch together.

8. A lamp for use with a replaceable bulb capsule, comprising an outer envelope having a rear portion and an opening therethrough, a light transmitting member on said front portion, mounting means on said rear portion and including a hole, a removable member including a threaded base and a socket, said socket protruding through said hole and into space defined by said outer envelope and being constructed to removably receive a replacement bulb capsule, and means for retaining said removable member on said mounting means, said retaining means including first keeper structure on said mounting means and second keeper structure on said removable member, said first and second keeper structures being constructed and arranged to releasably prevent removal of said removable member from said mounting means.

9. A lamp for use with a replaceable bulb capsule, comprising an outer envelope having a rear portion and an opening therethrough, a light transmitting member on said front portion, mounting means on said rear portion and including a hole, a removable member including a threaded base and a socket, said socket protruding through said hole and into the space defined by said outer envelope and being constructed to removably receive a replacement bulb capsule, and means for retaining said removable member on said mounting means, said retaining means further including first keeper structure on said mounting means and second keeper structure on said removable member, said first and second keeper structures having a first position wherein said removable member can be applied to and removed from said mounting means and having a second position to releasably prevent removal of said removable member from said mounting means, said retaining means further including first latching structure on said mounting means and second latching structure on said removable member, said first and second latching structures having a latching position to prevent movement of said keeper structures to the first position and an unlatching position to accommodate movement of said keeper structures to the second position thereof.

10. A lamp for use with a replaceable bulb capsule, comprising an outer envelope having a rear portion and an opening therethrough, a light transmitting member on said front portion, mounting means on said rear portion and including a hole, a removable member including a threaded base and a socket, said socket protruding through said hole and into the space defined by said outer envelope and being constructed to removably receive a replacement bulb capsule, and means for retaining said removable member on said mounting means, said mounting means further including a skirt encompassing said rear portion and being attached thereto.

11. A lamp comprising a reflector having a front portion and a rear portion and an opening through said rear portion, a light transmitting member attached to said front portion, mounting means on said rear portion and including a hole, a removable member including a threaded base and a socket, said socket protruding through said hole and into the space defined by said reflector, means for retaining said removable member on said mounting means, and a replaceable bulb capsule including a male element which is removably mated with said socket.

12. The lamp of claim 11 wherein said socket includes two substantially parallel holes and two terminals respectively therein, said bulb capsule including two substantially parallel pins respectively inserted into said holes and into engagement with said terminals.

13. The lamp of claim 11, wherein said replaceable bulb capsule includes a ceramic base carrying a pair of substantially parallel pins, and a bulb having a pair of leads respectively electrically connected to said pins.

14. The lamp of claim 11, wherein said bulb includes a glass envelope filled with halogen and other gases under high pressure.

15. A lamp for use with a replaceable bulb, comprising an outer envelope having a rear portion and an opening therethrough, mounting means on said rear portion and including a hole and at least one tongue which laterally extends into said hole and at least one latching notch and at least one edge between said tongue and said notch, a removable member including a threaded base and a head and a socket formed in said head, said socket protruding through said hole and into the space defined by said reflector and being constructed to removably receive a replaceable bulb capsule, said head having at least one longitudinally extending groove therein and at least one circumferentially extending groove therein, during assembly said head being inserted into said hole with said tongue projecting into said longitudinally extending groove, said removable member being rotatable to another position to place said tongue in said circumferentially extending groove to preclude withdrawal of said removable member, at least one latching element attached at one end thereof to said head and having a finger engagement portion at its other end and a camming portion in between, said latching element being movable between latching and unlatching positions, said camming portion engaging said edge as said head is inserted into said hole and deflecting said camming portion toward said head, said camming portion entering said latching notch as said removable member is rotated to the latching position, said removable member being rotatable back to its original position to enable withdrawal thereof by depressing said engagement portion.

16. The lamp of claim 15, and further comprising a latching element identical to said first mentioned latching element and being mounted on said head at a diametrically opposed side thereof, and said mounting means includes a further latching notch diametrically opposed to said first mentioned latching notch.

17. The lamp of claim 15, wherein said head has a longitudinally extending recess therein to accommodate said latching element.

18. The lamp of claim 15, wherein said head has a further longitudinally extending groove therein diametrically opposed to said first mentioned longitudinally extending groove and said mounting means has a further tongue opposed to said first mentioned tongue.

19. The lamp of claim 15, wherein said head is generally cylindrical.

20. The lamp of claim 15, wherein said head is composed of ceramic.

* * * * *